73-151 SR
6/23/87 OR 4,674,328

United States Patent [19]
Ward et al.

[11] Patent Number: 4,674,328
[45] Date of Patent: Jun. 23, 1987

[54] METHOD AND APPARATUS FOR DETERMINING SUBSURFACE CONDITIONS USING A TUBING PACKOFF TOOL

[75] Inventors: Richard M. Ward, LaPorte; Vernie C. McWhirter, Pearland, both of Tex.

[73] Assignee: Dresser Industries, Inc., Dallas, Tex.

[21] Appl. No.: 757,054

[22] Filed: Jul. 19, 1985

[51] Int. Cl.[4] ..... E21B 47/00; E21B 33/12
[52] U.S. Cl. ..... 73/151; 73/152
[58] Field of Search ..... 73/151, 152, 155; 166/250, 118, 387; 340/853, 856; 367/81

[56] References Cited

U.S. PATENT DOCUMENTS

| | | | |
|---|---|---|---|
| 2,702,474 | 2/1955 | Johnston | 73/152 |
| 3,308,882 | 3/1967 | Lebourg | 73/155 X |
| 3,357,504 | 12/1967 | Calhoun | 175/4.52 |
| 3,364,993 | 1/1968 | Skipper | 166/250 |
| 3,373,604 | 3/1968 | Dudman | 73/152 |
| 3,905,227 | 9/1975 | Kinley | 73/151 |
| 4,046,006 | 9/1977 | Dufrene | 73/151 |
| 4,200,297 | 4/1980 | Tricon | 277/102 |
| 4,404,659 | 9/1983 | Upchurch | 166/374 |
| 4,423,625 | 1/1984 | Bostic, III et al. | 73/155 |
| 4,482,013 | 11/1984 | Fulkerson | 166/118 |

*Primary Examiner*—Stewart J. Levy
*Assistant Examiner*—Scott M. Oldham
*Attorney, Agent, or Firm*—Patrick H. McCollum

[57] ABSTRACT

A method and apparatus are provided for permitting an instrumentation package to be repeatedly locked and unlocked at any number of desired depths inside a subsurface production tube for the determination of the shut-in physical conditions at those depths. An instrumentation package is located below a tube packoff tool. The instrumentation package and tube packoff tool combination are lowered into the tube. At the desired depth, a longitudinal force is exerted on the tube packoff tool, causing the tube packoff tool to wedge against the inside of the tube, locking the tube packoff tool at that depth, and creating a seal which isolates the instrumentation package below. The instrumentation package then begins its determination of the shut-in physical conditions inside the tube at that depth and transmits the acquired data to a surface recording and processing facility. When sufficient data has been collected, the tube packoff tool can be unlocked by relaxing the upward force on the tube packoff tool, breaking the isolating seal, and unlocking the tube packoff tool from its position inside the tube. At this point, the tube packoff tool and instrumentation package may either be taken to another location inside the tube and relocked using the same procedure for determination of the physical conditions at the tube at an additional depth or removed from the tube. The locking and unlocking procedure may be repeated as many times as desired prior to the removal of the tube packoff tool and the instrumentation package from the tube. An emergency release mechanism is incorporated in the tool that allows the tool to be safely released from the tubing locked position by exerting an upward force on the tube packoff tool. This will allow pressure to equalize across the tube packoff tool before disengaging the tool form the locked position by a downward motion.

1 Claim, 6 Drawing Figures

METHOD AND APPARATUS FOR DETERMINING SUBSURFACE CONDITIONS USING A TUBING PACKOFF TOOL

BACKGROUND OF THE INVENTION

This invention relates generally to improved method and apparatus for investigating subsurface conditions within a borehole traversing earth formations, and more particularly to improved techniques for measuring shut-in conditions within a subsurface production tube string.

In the past, it has been difficult to determine the shut-in temperature, pressure, and other physical conditions inside a narrow subsurface production tube. The narrow confines and extreme environmental conditions of the tube made accurate readings difficult. An early solution to this problem was to place a recorder down the tube to a specified depth to record the desired physical conditions within the tube at that depth and then remove the recorder to analyze the acquired data. This solution was unsatisfactory for two reasons: First, the extreme environmental conditions caused excessive recorder failure and/or the receipt of inaccurate results. Second, this procedure was of limited value in that there was a time delay before the recorder could be removed and physical conditions determined. Thus, instantaneous physical conditions inside the tube were not available using this procedure.

One object of this invention is to enable a surface facility to be able to determine at shut in conditions physical conditions inside the tube instantaneously through the use of an instrumentation package being placed inside the tube at a specified depth to transmit data related to the physical conditions inside the tube to a surface facility.

Another object of this invention is to enable the surface recording of the physical conditions within the tube at an unlimited number of depth positions inside the tube through the use of an instrumentation package combined with a tubing packoff tube. When triggered off by an longitudinal force, the tube packoff tool locks into the desired position inside the tube and isolates the instrumentation package below to permit accurate readings of the shut-in physical conditions within the tube over a period of time in a shut in condition. The tubing packoff tool may later be unlocked from its position, moved to another location inside the tube where the determination of physical conditions is also desired, and then relocked to again isolate the instrumentation package for additional readings. This procedure may be repeated an unlimited number of times.

SUMMARY OF THE INVENTION

The invention relates to a method and apparatus for the placement and isolation of an instrumentation package at an unlimited number of specified locations in the narrow confines of a subsurface production tube for the determination of shut-in physical conditions inside the tube which can then be immediately relayed to a surface facility. More particularly, the invention relates to the ability to lock and seal off repeatedly an instrumentation package at a desired depth inside a narrow tube.

An instrumentation package is tied below a tubing packoff tool. The instrumentation package and tubing packoff tool are then lowered into the tube. When the instrumentation package has reached the depth where data on the physical conditions inside the tube are desired, a longitudinal force is exerted upon the mandrel of the packoff tool by either pulling on the wireline or by other means. The entire tubing packoff tool begins to move in response to this force with the exception of the upper sleeve which is held in place inside the tube. The tapered end of the lower sleeve of the packoff tool moves inside the slips of the upper sleeve, pushing the slips outward until they contact with the tube and lock the packoff tool into position. A continued force on the mandrel drives the element backup sub into the compressible packoff rubber element which extends outward until it creates a seal with the tube, effectively isolating the instrumentation package below. Continued tension of the wireline will keep the packoff tool in the locked and sealed position. To unlock the device for movement to another location inside the tube, an opposite longitudinal force is applied to the mandrel of the packoff tool. This force may be achieved by various methods. A preferred method of obtaining this force is to slack-off on the wireline to release the tension on the wireline. With a slack wireline, the weight of the tube packoff tool will supply the needed downward force. The downward pressure will allow the element back-up sub to drop back down and the compressible packoff element to break its seal with the tube by returning to its normal shape. Continued downward pressure will also allow the tapered end of the lower sleeve to disengage the slips and allow the slips to return to their normal position, disengaging the tube, and unlocking the packoff tool. The packoff tool is then lowered in order to reset the slip carrier into a running position. The instrumentation package is now free to be raised or lowered to another location where data on the physical conditions of the tube are desired.

BRIEF DESCRIPTION OF THE DRAWINGS

For a more complete understanding of the present invention and, for further objects and advantages thereof, reference may now be had to the following description taken in conjunction with the accompanying drawings.

DESCRIPTION OF THE PREFERRED EMBODIMENT

Configuration of Apparatus

Figure 1:
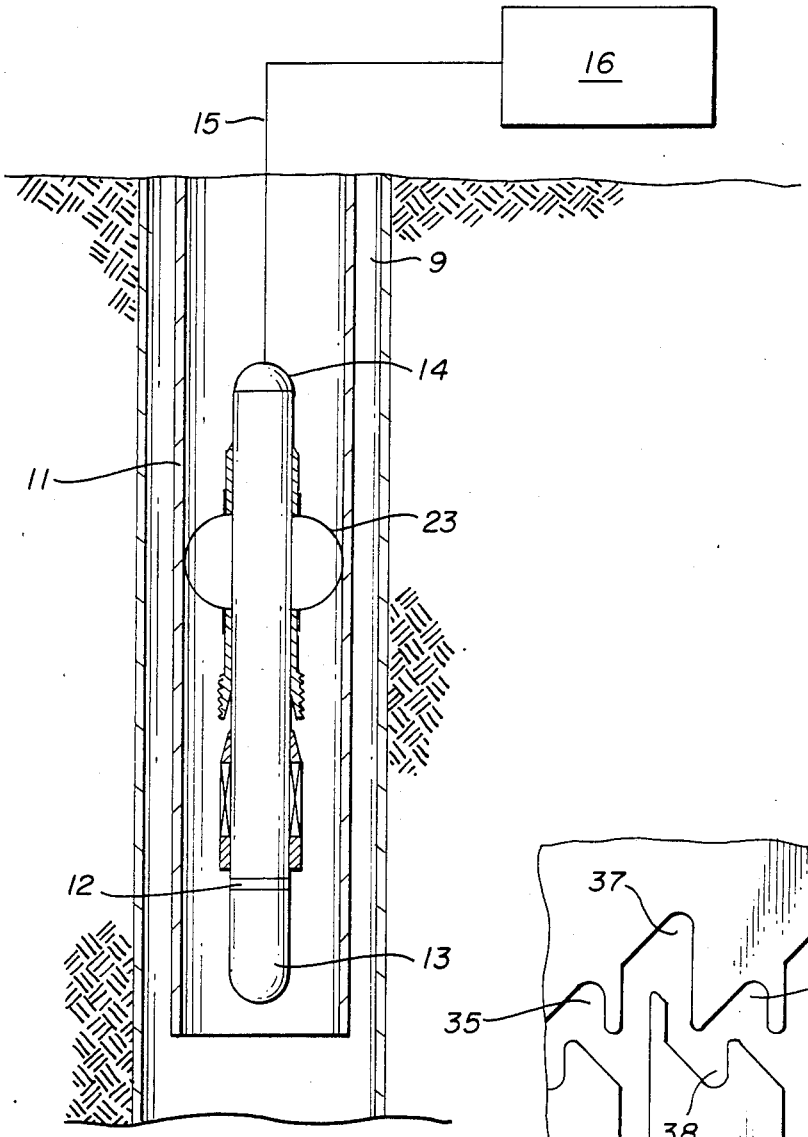
FIG. 1 is a fragmentary, cross sectional, side elevational view of the system used to instantaneously determine physical conditions inside a tube.

Referring to FIG. 1, there is shown a cross sectional view of the system used to determine subsurface conditions at a desired location point inside a subsurface tube and have that data available for immediate inspection at a surface facility. A tube packoff tool 10 is in a given position inside a narrow sursurface production tube 11 located within a well 9, which may be cased or uncased. The packoff tool 10 is connected through its lower coupling sub 12 to an instrumentation package 13 which is capable of measuring pressure, temperature, and other physical conditions at the position in the tube 11 which the instrumentation package 13 is located. The packoff tool 10 is further connected through its upper coupling sub 14 to a wireline 15. The wireline 15 runs from a surface recording and processing facility 16, through the center of the tube packoff tool 10 and to the instrumentation package 13. The wireline 15 is capable of transporting signals regarding the physical condition inside the tube from the instrumentation package 13 to the surface facility 16.

Referring to FIG. 2, there is shown a fragmentary, side elevational view of the tube packoff tool 10 which is in a given position inside the tube 11. The tube packoff tool 10 consists primarily of a mandrel 17 and two elements concentric to the mandrel 17: the upper sleeve 18 and the lower sleeve 19. The upper sleeve 18 is slideably engaged with the mandrel 17 by means of two j-pins 20 and 21 which are fastened to the upper sleeve 18 and which are free to move within the w-slot 22 (illustrated in FIG. 3) which is milled into the mandrel 17. The upper sleeve 18 is fastened to a plurality of drag springs 23. Each drag spring 23 extends outward sufficiently to contact the inside wall of tube 11. Each drag spring 23 is also secured to a spring cantilever beam 24, which in turn is fastened to a slip 25. Each slip 25 has multiplicity of sharp edges 26 on the side which faces the tube 11. The mandrel is further provided with a plurality of air exit ports 27 in the mandrel 17 which are preferably positioned between the upper sleeve 18 and the lower sleeve 19.

The lower sleeve 19 with a tapered end 28 is in contact with a compressible rubber packoff element 29. The compressible packoff element 29 is in contact with the element back-up sub 30. The element back-up sub 30 is fastened to the lower sleeve 19, having at least one equalizer port 34, therein. The element back-up sub 30 is fastened to the mandrel 17 through the use of two shear pins 32 and 33. The mandrel 17 is further fastened to a equalizer sub 31 which has two O-ring seals 35 which are positioned on both sides of and seal off the air entry ports 34 in the lower sleeve 19.

Operation of Apparatus

Figure 3:
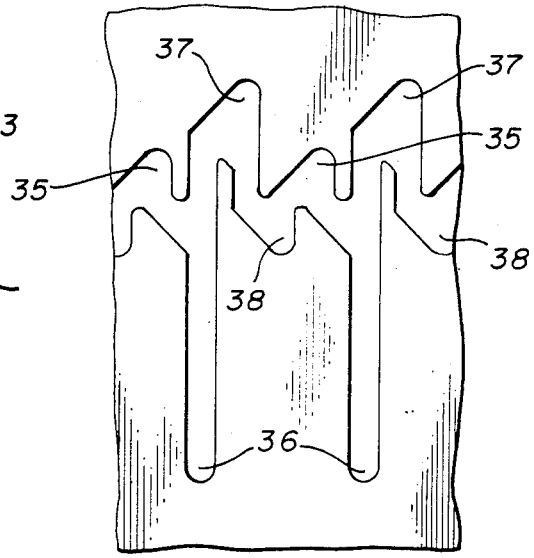
FIG. 3 is a developed plan view of the w-slot system shown in FIG. 2.
Figure 2A:
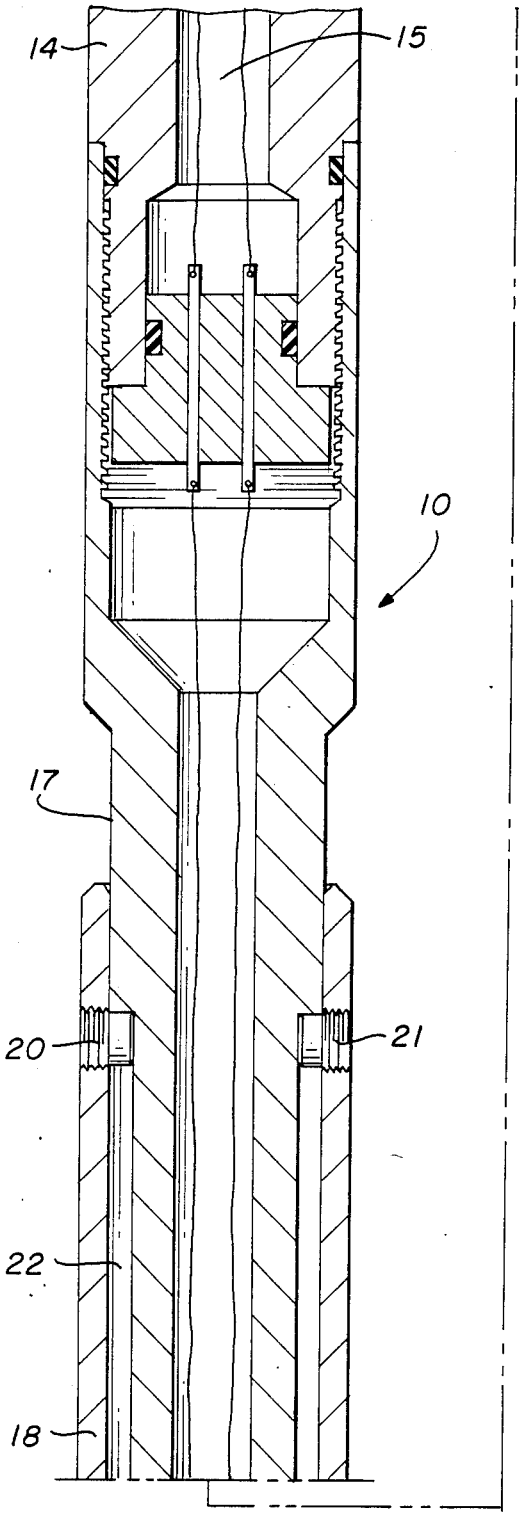
FIG. 2 is a fragmentary vertical sectional view of the tube packoff tool which is in a given position inside the tube.
Figure 2B:
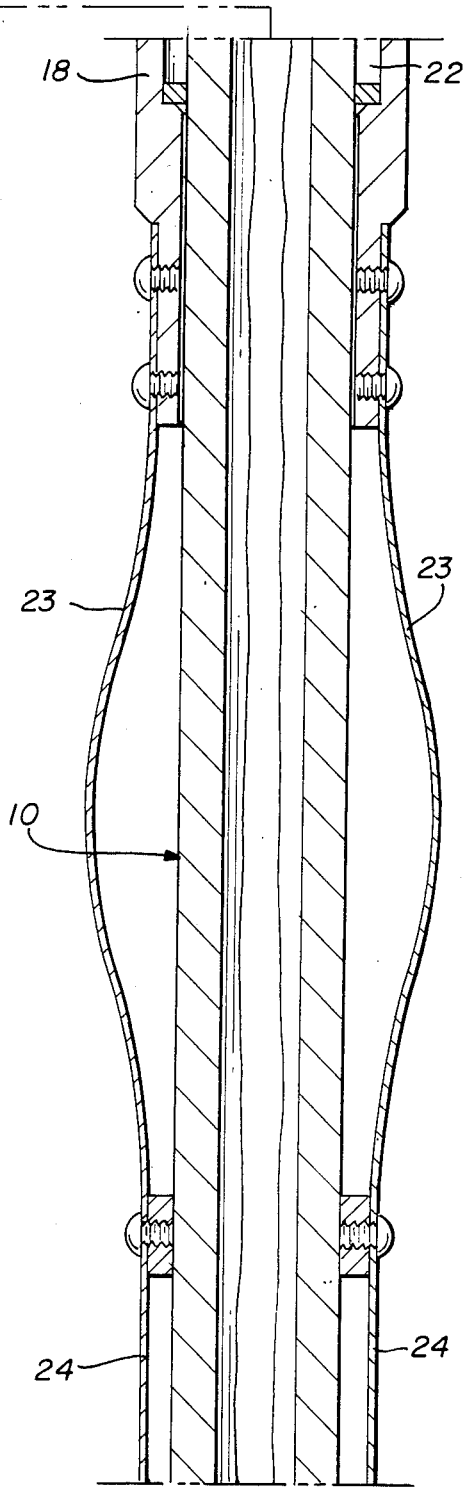
Figure 2C:
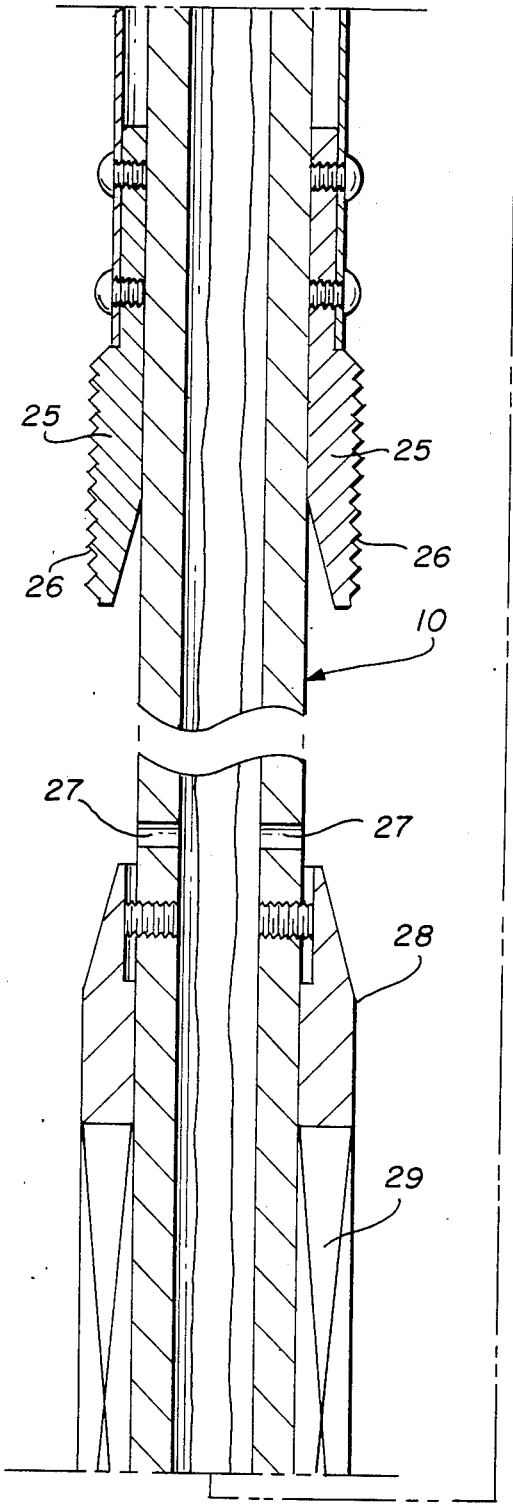
Figure 2D:
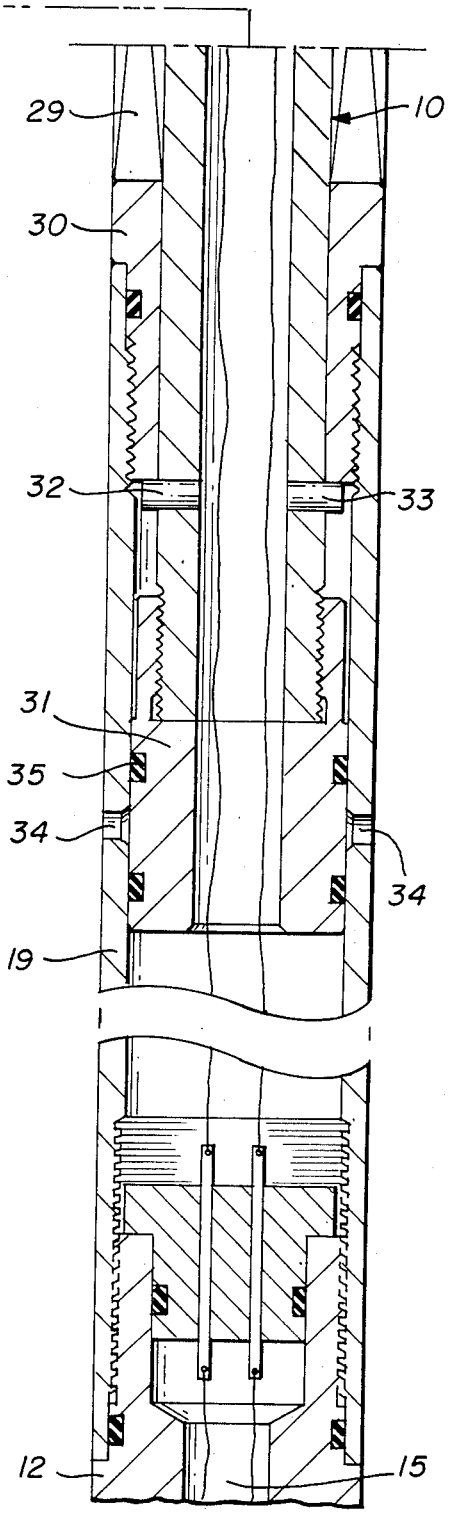

In operation, the parts of the tubing packoff tool 10 are assembled as shown in FIG. 2 and described in the above configuration of apparatus. Referring to FIG. 3, the j-pins 20 and 21 of FIG. 2 are set in position 39 of the w-slot 22. When an operator at the surface exerts an upward force upon the wireline 15, the packoff tool 10 will begin to move upward with the exception of the upper sleeve 18. The upper sleeve 18 will remain in a substantially stationary position because of friction created by the contact of the drag springs 23 and the inside wall of tube 11. The lower sleeve 19 will move upward and the tapered end 28 will make contact with the slips 25. The slips 25 will move outward and the sharp edges 26 of the slips 25 will contact the inside wall of the tube 11. The slips 25 will wedge against the tube 11, stopping the upward motion of the tapered end 28, and locking the packoff tool 10 into a stationary position. Continued upward force upon the wireline 15 will cause the element back-up sub 30 to continue to move upward and push against the compressible packoff element 29. The compressible packoff element 29 will be expanded outward until it comes into contact with the inside of tube 11 and create a seal between the tube 11 and the compressible packoff element 29. FIG. 3, the j-pins 20 and 21 will have reached the position 36. The upward motion of the wireline 15 is held in place, sealing the inside of the tube, locking the packoff tool 10 into the desired position, and allowing the instrumentation package 13 to begin readings in a shut-in state within the tube 11.

To unlock the instrumentation package 13 and the tube packoff tool 10 from their locked position, the upward pressure on wireline 15 is relaxed. When the wireline 15 goes slack, the element back-up sub 30 will move back down on mandrel 17. As the element back-up sub 30 begins to move down, the pressure on the compressible packoff element 29 will begin to subside and allow the compressible packoff element 29 to return to its normal shape, disengage the tube 11, and break the seal between the tube 11 and the compressible packoff element 29. The tapered end 28 will also move downward, permitting the sharp edges 26 to disengage the tube 11 and the slips 25 to return to their original position. As the tube packoff tool 10 is unlocked, the mandrel 17 will move down the tube 11 and the j-pins 20 and 21 will travel to position 37. The tube packoff tool 10 and the instrumentation package 13 are now free to move to another location inside the tube 11. If the next location inside the tube 11 where data on physical conditions is desired is further down the hole, the tube packoff tool 10 will be lowered down the tube while the j-pins 20 and 21 will stay in position 37. If the next location inside the tube 11 where data on physical conditions desired is closer to the surface, the packoff tool 10 will be raised up the hole while the j-pins will travel to position 38.

In an alternative embodiment of the invention, the instrumentation package 13 and the wireline packoff device 10 are released by the exertion of an upward force upon the wireline 15. This method can serve as an emergency release of the tool when the tool fails to release after following the above described procedure. The mandrel 17 will be pulling upward while the lower sleeve 19 and shear pins 32 and 33 will be held in place and prevented from moving upward by the compressible packoff element 29. The shear pins 32 and 33 will shear and allow the equalizer sub 31 to be pulled up by the mandrel 17. The O-ring seal 35 will move across the port 34, allowing pressure to pass through the port 34, enter the interior of the mandrel 17, and exit the air exit ports 27, equalizing pressure on both sides of the seal. Once the pressure has been equalized, a downward force is exerted upon the wireline 15. This downward force will allow the element back up sub 30 to drop down and allow the compressible packoff element 29 to return to its normal shape, disengage the tube 11, and break the seal between tube 11 and the compressible packoff element 29. The tapered end 28 will also move downward, allowing the sharp edges 26 to disengage from the tube 11 and allowing the slips 25 to return to their original position. The j-pins 20 and 21 will move into the position 37. The tube packoff tool 10 and instrumentation package 13 are now unlocked and free to move within the tube 11. After the tool packoff tool 10 is released from the locked position by exerting upward pressure on the wireline 15 to shear the shear pins 32 and 33, the tube packoff tool 10 and instrumentation package 13 must be removed from the tube 11.

The embodiments of the invention in which an exclusive property or privilege is claimed are defined as follows:

1. A wireline conveyed packer and testing apparatus for obtaining at a surface location instantaneous electrical measurements of conditions within a production tubing within a wellbore under shut-in conditions, comprising:

an elongated mandrel member coupled at first end to a wireline, said mandrel member including a longitudinal bore therethrough;

a first sleeve member concentrically disposed about said mandrel, said first sleeve member coupled to said mandrel by j-pins fastened to said first sleeve member which move within a w-slot on said mandrel upon longitudinal manipulation of said mandrel by said wireline;

a plurality of drag spring members having a first end coupled to said first sleeve member, said drag spring members adapted to contact the internal surface of the production tubing to retard movement of said first sleeve member in relation to longitudinal movement of said mandrel;

a spring cantilever member at a first end coupled to a second end of said plurality of drag spring members;

a slip member assembly disposed about said mandrel, said slip member assembly coupled to a second end of said spring cantilever member;

a second sleeve member concentrically disposed about said mandrel, said second sleeve having a first tapered end portion for engaging and expanding said slip member into contact with the internal surface of said production tubing in response to longitudinal manipulation of said mandrel by said wireline;

a compression expandable packoff element concentrically disposed about said mandrel below said second sleeve member;

a back-up sub member concentrically disposed about said mandrel below said packoff element;

a third sleeve member concentrically disposed about said mandrel, said third sleeve member coupled to said back-up sleeve;

a shear member coupling said third sleeve member to said mandrel said shear member adapted to shear in response to a predetermined longitudinal force exerted on said mandrel by said wireline;

a pressure equalizer system including a pressure sub member disposed in said third sleeve member and coupled to said mandrel and a pressure path from below-to-above said packoff element, said pressure path established by movement of said equalizer sub member in said third sleeve member; and an instrumentation package coupled to said third sleeve member for obtaining measurements of conditions within said production tubing.

* * * * *